United States Patent [19]

Hewes

[11] 4,120,434

[45] Oct. 17, 1978

[54] BELT SUPPORTED CAMERA CADDY

[76] Inventor: Donald R. Hewes, Rte. 2, Box 224D, Newberg, Oreg. 97132

[21] Appl. No.: 783,081

[22] Filed: Mar. 30, 1977

[51] Int. Cl.[2] ..... A45F 5/02

[52] U.S. Cl. ..... 224/5 V; 224/3; 224/5 A

[58] Field of Search ..... 150/52 J; 224/2 F, 3, 224/5 R, 5 A, 5 E, 5 J, 5 V, 25 R, 26 B, 28 R, 28 B, 28 D; 240/52.5, 103, 108; 354/293; 24/3 R, 3 A, 3 F

[56] References Cited

U.S. PATENT DOCUMENTS

| | | | |
|---|---|---|---|
| 1,022,791 | 4/1912 | Laird, Jr. | 224/2 F |
| 2,894,119 | 7/1959 | Stenger | 224/5 A X |
| 3,369,723 | 2/1968 | Saari et al. | 224/5 R |
| 3,813,017 | 5/1974 | Pimsleur | 150/52 J X |
| 3,912,137 | 10/1975 | Tomatsuri | 224/5 V |

*Primary Examiner*—Trygve M. Blix
*Assistant Examiner*—Winston H. Douglas
*Attorney, Agent, or Firm*—Clarence A. O'Brien; Harvey B. Jacobson

[57] ABSTRACT

An elongated strip of flexible and resilient material is provided. The strip includes first and second openings formed through the opposite end portions thereof and the central portion of the strip includes a plurality of parallel elongated slots extending longitudinally of the strip and spaced transversely thereof. The openings in the opposite ends of the strip are of a size to receive the lens barrel of a camera therethrough about which the strip is wrapped and the slotted intermediate portion of the strip may have the user's waist belt threaded therethrough in order to secure the strip to the user and thus support a camera from the waist of the user. The opening in one end portion of the strap is slightly smaller in transverse dimension than the opening formed in the other end of the strip and the strip may be constructed of any suitable material such as rubber or a similar substance.

7 Claims, 4 Drawing Figures

BELT SUPPORTED CAMERA CADDY

BACKGROUND OF THE INVENTION

Various devices have been heretofore provided for attaching cameras to the belt of the user, for carrying cameras and for attaching other articles to a waist-encircling belt. However, most of these previously known devices are relatively complex in structure or are not specifically designed for supporting a camera from the belt of a user in a secure manner.

Accordingly, a need exists for a belt-attached holder for supporting a camera from the belt of a user in a manner such that access to the camera for picture-taking purposes may be quickly had.

Examples of various forms of camera supports and enclosures as well as belt supports for other articles and which include some of the general structural and operational features of the instant invention are disclosed in U.S. Pat. Nos. 2,308,003, 3,158,300, 3,209,968, 3,294,298, 3,450,317, 3,520,241, 3,762,616 and 3,813,017.

BRIEF DESCRIPTION OF THE INVENTION

The camera caddy of the instant invention comprises a single strip of flexible and resilient material having lens barrel assembly-receiving openings formed through its opposite end portions and transversely spaced, elongated and longitudinally extending slots formed through its midportion. The user of the caddy may thread his belt through the slots in order to attach the caddy to his belt and the strap comprising the caddy may be wrapped about the camera with the opposite ends of the strap disposed in overlapped engagement and the lens barrel of the camera received through the openings in the overlapped ends of the strap. In this manner, the camera may be securely supported from the belt of a user. In addition, the resiliency of the material from which this strap is constructed enables the outermost overlapped end of the strap to be first removed from engagement with the lens barrel after which the second end of the strap may be stripped from the lens barrel thereby freeing the camera from the strap for ready use.

At any time it is desired to resupport the camera from the caddy, the camera is placed alongside the strap and the first end portion of the strap is placed over the lens barrel and the remaining end portion of the strap is thereafter wrapped about the remaining portion of the camera and placed over the lens barrel.

The main object of this invention is to provide a convenient caddy for supporting a camera from the belt of a user.

Yet another object of this invention is to provide a camera caddy that will be adapted to support cameras of different sizes and manufacture but of generally the same type.

Another important object of this invention is to provide a camera caddy capable of supporting the associated camera in a lens-downward direction for protection of the lens of the camera even though the latter is not provided with a lens cap.

A final object of this invention to be specifically enumerated herein is to provide a lens caddy in accordance with the preceding objects and which will conform to conventional forms of manufacture, be of simple construction and easy to use so as to provide a device that will be economically feasible, long-lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
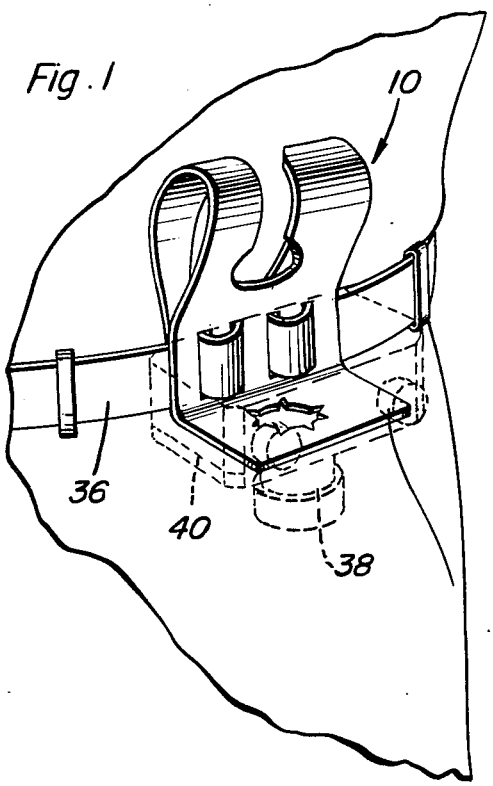
FIG. 1 is a perspective view of the caddy of the instant invention supported from the belt of a user and with the caddy in an open position, a conventional form of camera being illustrated in phantom lines in operative association with the caddy.
Figure 2:
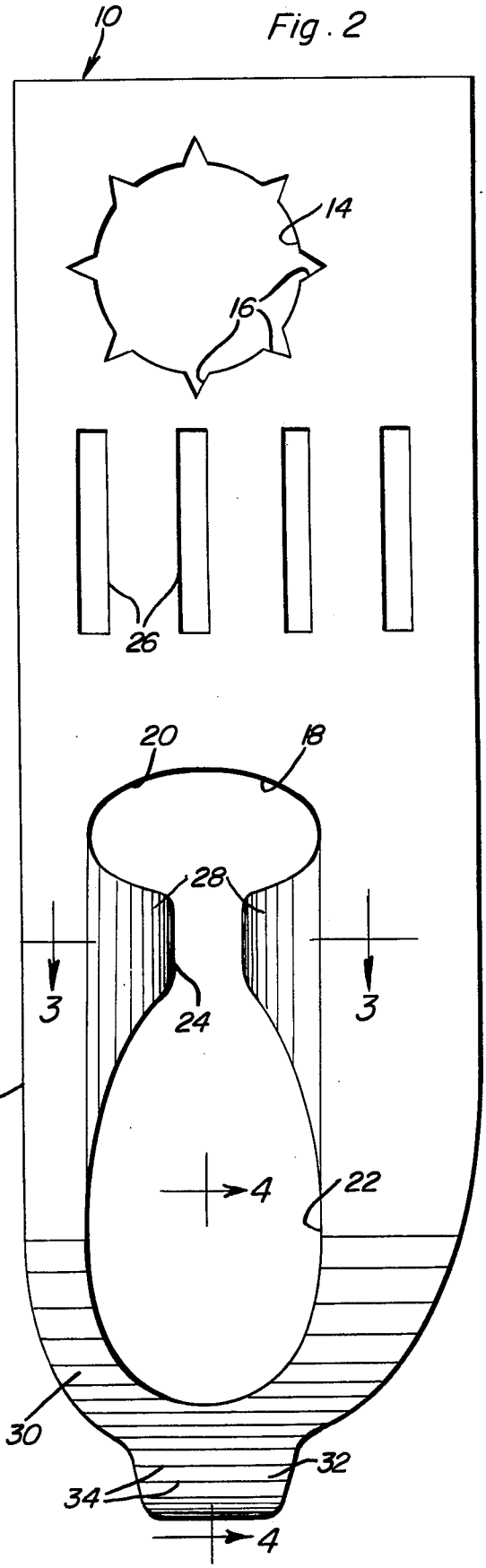
FIG. 2 is a plan view of the resilient strip comprising the caddy.
Figure 3:
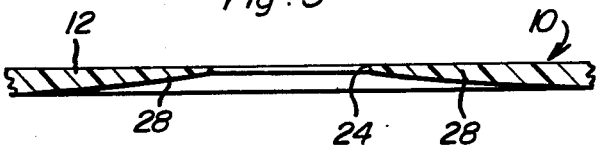
FIG. 3 is a fragmentary enlarged sectional view taken substantially upon the plane indicated by the section line 3—3 of FIG. 2.
Figure 4:
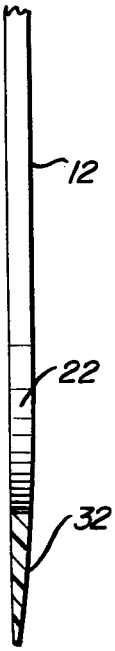
FIG. 4 is a fragmentary enlarged sectional view taken substantially upon the plane indicated by the section line 4—4 of FIG. 2.

Referring now more specifically to the drawings the numeral 10 generally designates the camera caddy of the instant invention. The caddy 10 comprises an elongated strip 12 of flexible resilient material such as rubber or a similar substance. The strip 12 is approximately 4½ inches wide and 14 inches long. Further, the strip 12 is approximately ⅛ of an inch thick and has a first generally circular opening 14 formed in one end portion thereof. The strip 12 includes circumferentially spaced V-shaped notches 16 formed therein about the opening 14 opening into the latter and the opposite end portion of the strip 12 includes a second opening 18 formed therein. The opening 18 includes an oval-shaped end portion 20 and an opposite more elongated oval-shaped end portion 22 with a narrow elongated neck portion 24 communicating the end portions 20 and 22. The major dimension of the oval end portion 20 extends transversely of the strip 12 and the major dimension of the oval-shaped end portion 22 extends longitudinally of the strip 12 with the neck portion 24 extending longitudinally of the strip 12 between the adjacent portions of the end portions 20 and 22.

An intermediate portion of the strip 12 includes four transversely spaced and longitudinally extending slots 26 formed therein and the portions 28 of the strip 12 defining the neck portion 24 extending between the end portions 20 and 22 taper toward the neck portion 24 to a thickness of approximately 1/16 of an inch. In addition, the terminal end portion 30 of the strip 12 remote from the opening 14 and defining the end of the opening 18 remote from the slots 26 tapers in thickness of define an end tab 32 which is approximately 1/16 of an inch thick and provided with finger-engageable ribs 34.

In operation, the strip 12 is secured to the user's belt 36 in a manner which is believed to be obvious from FIG. 1 of the drawings by threading the belt 36 through the slots 26 with the opening 14 disposed lowermost. Then, the end portion of the strip 12 in which the opening 14 is defined is bent outward and upward into a horizontally outwardly projecting position and the lens barrel assembly 38 of the camera 40 is inserted through the opening 14, the notches 16 facilitate the reception of the lens barrel assembly 38 through the opening 14. Thereafter, the other end portion of the strap 12 is bent outwardly and downwardly over the camera 40 and horizontally inwardly with the strip 12 under longitudinal tension so as to slightly stretch the latter and the end portion of the strip 12 remote from the opening 14 is placed over the lens barrel assembly 38 with the latter received through the opening 18. The portions 28, by being tapered, serve to facilitate the placement of the corresponding end portion of the strip 12 over the lens barrel assembly 38 while the strip 12 is under longitudinal tension.

Once the end portions of the strip 12 have been disposed in overlapped engagement with the lens barrel assembly 38 received through the openings 14 and 18, the camera 40 is securely supported from the caddy 10 against accidental dislodgement therefrom. Further, the camera 40 is supported from the caddy 10 in a lens-downward position whereby the lens barrel assembly 38 will be afforded maximum protection.

When it is desired to remove the camera 40 from the caddy 10, the tab 32 is engaged and pressure is applied to stretch the strip 12 while at the same time withdrawing the end portion of the strip 12 from which the tab 32 is supported from its position over the lens barrel assembly. Once the opening 18 has been disengaged from the lens barrel assembly, the lens barrel assembly may be readily withdrawn from the opening 14.

The caddy 10 is capable of supporting the camera 40 from the user's belt 36 in a secure manner with the belt threaded through the slots 26 and the user may walk, run or ski without worry that the camera 40 will fall from the caddy 10. However, the camera 40 may be readily withdrawn from the caddy 10 whenever it is desired to take a picture.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with a camera of the type including a body defining front and rear sides, top and bottom sides extending between said front and rear sides and a lens barrel assembly projecting outwardly from the front side of said body, a camera caddy comprising an elongated strip of flexible and resilient material, opposite end portions of said strip having first and second barrel assembly receiving openings formed therethrough, said strip including a longitudinally extending central portion located between said openings and extending from one of said opposite end portions to the other of said opposite end portions, said central portion having closed ended, transversely spaced longitudinal belt receiving slots formed therein for enabling said strip to be attached to a waist belt of the user, said strip being of a length to snugly encircle a portion of said camera with the opposite end portions of said strip disposed in end overlapped relation with said lens barrel assembly removably projecting through said openings and said central portion overlying the bottom side of said camera when said camera caddy is supporting the camera from the user's belt with the belt threaded through said slots.

2. The combination of claim 1 wherein one of said openings is smaller in total area than the other of said openings and is disposed inwardly of the other opening along said lens barrel assembly from the outer free end of the lens assembly.

3. The combination of claim 2 wherein said other opening is elongated longitudinally of said strip.

4. The combination of claim 3 wherein the portions of said strip defining the opposite longitudinal sides of said other opening include tab portions projecting into said other opening.

5. The combination of claim 4 wherein said tab portions are elongated and extend lengthwise along said opposite longitudinal sides of said other opening and terminate spaced distances from the opposite ends of said other opening.

6. The combination of claim 5 wherein said tab portions taper in thickness inwardly toward the free ends thereof projecting into said other opening.

7. A caddy for use in removably supporting a camera from the waist belt of a user and wherein the camera is of the type including a body defining front and rear sides, top and bottom sides extending between said front and rear sides and a lens barrel assembly projecting outwardly from the front side of the body, said caddy comprising an elongated strip of flexible and resilient material, opposite end portions of said strip having first and second barrel assembly-receiving openings formed therethrough, said strip including a longitudinally extending central portion located between said openings and extending from one of said opposite end portions to the other of said opposite end portions, said central portion having closed ended, transversely spaced longitudinal belt receiving slots formed therein for enabling said strip to be attached to a waist belt of the user, said strip being of a length to snugly encircle a portion of said camera with the opposite end portions of said strip disposed in end overlapped relation with said lens barrel assembly removably projecting through said openings and said central portion overlying the bottom side of said camera when said camera caddy is supporting the camera from the user's belt with the belt threaded through said slots.

* * * * *